US008272341B2

(12) United States Patent
König et al.

(10) Patent No.: US 8,272,341 B2
(45) Date of Patent: Sep. 25, 2012

(54) DEVICE AND METHOD FOR CUTTING TEXTILE AND NON-TEXTILE SHEET MATERIALS

(75) Inventors: Michael König, Constance (DE); Markus Müller, Fruthwilen (CH); Frank Prüfer, Hilzingen (DE)

(73) Assignee: BERNINA International AG, Steckborn (CH)

( * ) Notice: Subject to any disclaimer, the term of this patent is extended or adjusted under 35 U.S.C. 154(b) by 434 days.

(21) Appl. No.: 12/554,061

(22) Filed: Sep. 4, 2009

(65) Prior Publication Data

US 2010/0050915 A1 Mar. 4, 2010

(30) Foreign Application Priority Data

Sep. 4, 2008 (CH) ..... 1411/08
Sep. 4, 2008 (CH) ..... 1412/08

(51) Int. Cl.
*D05B 37/06* (2006.01)
*D05B 37/00* (2006.01)

(52) U.S. Cl. ..... 112/89; 112/128

(58) Field of Classification Search ..... 112/85, 112/89, 98, 122–130, 226, 475.17; 83/13, 83/698, 71, 905, 910, 936
See application file for complete search history.

(56) References Cited

U.S. PATENT DOCUMENTS

| | | | | |
|---|---|---|---|---|
| 881,894 | A * | 3/1908 | Braun | 112/89 |
| 938,884 | A * | 11/1909 | Moriggl | 112/89 |
| 3,765,350 | A * | 10/1973 | Sztari | 112/122 |
| 3,948,194 | A * | 4/1976 | Gunold | 112/131 |
| 5,361,713 | A * | 11/1994 | Suzuki | 112/68 |
| 5,555,834 | A * | 9/1996 | Bonner | 112/129 |
| 6,006,685 | A * | 12/1999 | Kastrup et al. | 112/68 |
| 7,966,955 | B2 * | 6/2011 | Niizeki | 112/89 |

FOREIGN PATENT DOCUMENTS

WO 9824962 6/1998

* cited by examiner

*Primary Examiner* — Ismael Izaguirre
(74) *Attorney, Agent, or Firm* — Volpe and Koenig, P.C.

(57) ABSTRACT

A device for cutting textile and non-textile sheet materials with a sewing machine having a turning device (9) that can be mounted on the lower end of the needle bar (5). A cutting needle (23) is inserted from below into the turning device (9) instead of a sewing needle and can be brought into the desired cutting position, for example, by a fin (17) that projects from the turning device (9).

12 Claims, 8 Drawing Sheets

DEVICE AND METHOD FOR CUTTING TEXTILE AND NON-TEXTILE SHEET MATERIALS

CROSS-REFERENCE TO RELATED APPLICATIONS

This application claims the benefit of Swiss Patent application Nos. 01411/08 and 01412/08, both filed on Sep. 4, 2008, the contents of which are incorporated herein by reference as if fully set forth.

BACKGROUND

The invention relates to a device and a method for cutting textile and non-textile sheet materials using a cutting needle.

From embroidery work, it is known to cut out areas of the embroidery material. These areas are typically created after completion of the embroidery process through suitable hand-guided knives or shears. In the case of industrial embroidery machines with multiple-needle heads, for example, individual needles are replaced by knives or cutting needles that perform the cutting work. In the case of such an embroidery machine, as described in WO98/24962, the knives are arranged at different cutting angle settings and are used alternately according to the contours to be cut out. In addition, it is known to provide in such machines, instead of several knives oriented differently, a separate rotary drive for aligning the cutting angle of an individual knife during the cutting process corresponding to the appropriate cutting direction. Such complicated devices cannot be used in household sewing machines.

SUMMARY

An object of the present invention is to provide a device and a method for cutting or cutting out textile and non-textile sheet materials, wherein this device and method can be used in household sewing machines.

This is attained by a device and by a method according to the features of the invention. Advantageous constructions of the device and the method are described below.

The device according to the invention can be mounted and put to use on any sewing machine, whether new or old. Thus, it is possible with no work on the mechanics of the sewing machine, to perform cutting work on the sewing or embroidery material by hand or, if embroidery programs are stored, also semi-automatically or fully automatically. In one especially advantageous construction of the invention, if present, the embroidery hoop drive in which the sheet material to be cut is tensioned can be used as a positioning drive for the angle setting of the cutting edge on the cutting needle. In another advantageous construction, the zigzag drive could be used as a positioning element for the angle setting of the cutting edge of the cutting knife.

The method according to the invention can be used in any sewing machines that are built in connection with a embroidery hoop for performing embroidery work, wherein the embroidery hoop can be moved with the sewing material or the textile or non-textile sheet material tensioned therein in a plane underneath the needle bar, and wherein the movements of the embroidery hoop and the needle bar are controlled by a controller. The sheet material can comprise, e.g., one or more plies. Especially in the case of thin plies, the sheet material could also comprise an underlying non-woven material. The method is also suitable for cutting films and the like. The sheet material does not absolutely have to be tensioned in a hoop and can be fed, e.g., by hand—as in the case of sewing—and/or by the feed dog of the sewing machine in the plane of the sewing material underneath the needle bar.

For cutting the sheet material, the cutting lines could be specified analogous to the contours of an embroidery image in the shape of embroidery data in a common format and cut by a cutting needle that is mounted on the needle bar instead of a sewing needle. For cutting the sheet material, the cutting needle can be turned or oriented by a turning device according to the invention in several given directions. The cutting line can be divided according to its local tangential direction into individual sections, wherein adjacent sections advantageously overlap. The best suited of the given cutting orientations are allocated to each of these sections. Advantageously, all of the associated cutting operations can be combined for each of these orientations—analogous to the embroidery operations with a certain sewing yarn color.

In particular, in the case of textile sheet materials, an underlayer, e.g., non-woven material is also usually placed underneath. The sheet material is advantageously secured to the flexible underlayer before the cutting with the cutting needle by selectable step or decorative stitches at a usually given or selectable small distance from the cutting line on one side or both sides of this cutting line. For cutting out contiguous parts of the sheet material, the stay stitching follows the contours to be cut out outside of the cutting line. Obviously, for this process a sewing needle is mounted on the needle bar instead of the cutting needle. The need to change the sewing or cutting needles can be signaled to the user advantageously on a display. The setting or changing of the rotational position of the cutting edge to the necessary value can be realized according to the construction of the invention automatically, e.g., with the help of the embroidery hoop drive or the zigzag drive or else by hand, after the controller has indicated the change to be performed, e.g., on a display.

After securing and cutting the cutting line, the controller can create, e.g., satin and/or decorative stitches along contours parallel to the cutting line after a sewing needle has been reattached to the needle bar. The parallel contours can be generated, e.g., between the cutting line and the stay stitching running parallel thereto, such that the satin stitches cover both the cut edge of the sheet material and also the stay stitching. Alternatively or additionally, in an analogous way decorative stitches could also be formed along parallel contours placed outside or behind the stay stitching with respect to the cutting line for a neater appearance of the sewing material.

The calculation of the embroidery data for the individual sections to be cut with different cutting orientations and also for the stay stitching and optionally for the satin and/or decorative stitches for neatening or embellishing the sewing material can be performed according to the corresponding conditions, e.g., by a PC and mouse, by a graphics tablet, tablet PC, or directly on the sewing machine using corresponding software. Here, a device or a program memory is provided with a program for processing embroidery data that is formed for executing one or more of the following steps:

- Creating and/or editing an embroidery pattern,
- Creating and/or editing a cutting line or calculating a cutting line at a distance that has been set or that can be set to an embroidery pattern,
- Creating and/or editing a cutting line from an embroidery pattern or from parts of an embroidery pattern (e.g., object in an overall embroidery pattern),
- Calculating sections of a cutting line, wherein these sections are to be cut with a cutting orientation of the cutting needle that has been set or that can be set, Combining sections of a cutting line that are to be cut with a given cutting orientation of the cutting needle into a sequence, Calculating or creating embroidery data for stay stitching to be formed at a distance that has been set or that can be set on one side or both sides of the cutting line, Calculating or generating embroidery data for parallel contours to be formed between the cutting line and the stay stitching for neatening the cut edge by satin stitches, such that the cut edge and the stay stitching are covered, Calculating or creating embroidery data for parallel contours at least forming given or selectable decorative stitches at a given distance to the cutting line or to the stay stitching, Creating an overall embroidery pattern file (in an arbitrary format) with the data of one or more cutting sequences applicable to one of the given cutting orientations, stay stitching, optionally one or more parallel contours to the cutting line for neatening the cut edge by satin stitches and/or for embellishing by decorative stitches.

Advantageously, the sewing machine controller is constructed to process, create, or edit overall embroidery patter files as mentioned. For cutting the sheet material, the controller of the sewing machine processes the points stored in the overall embroidery pattern file one after the other. Where decisions must be made on the further progress or where parameter values must be defined, the user is prompted by a display to perform the necessary actions. Below the series of steps are listed that could be performed for the cutting of sheet materials according to the invention:

Guaranteeing that the sewing needle is mounted on the needle bar,

Creating one or more stay stitches (corresponding to stored default settings or with reference to user inputs for the number and position relative to the cutting line), Prompting for mounting the cutting needle on the needle bar and optionally for orienting the cutting edge in the first of the necessary cutting edge orientations, Orienting the needle or the cutting edge in this first cutting direction (by hand or automatically, in that, e.g., the drive of the embroidery hoop or another drive of the sewing machine is used to activate a turning device between the needle bar and cutting needle, in order to bring the cutting edge into the first required orientation), Cutting the first sequence with all of the associated sections of the cutting line, Repeating the orientation and cutting for all of the other sequences with different cutting edge orientations, Prompting for the insertion of the sewing needle, Creating satin and/or decorative stitching corresponding to the selected or given parameters.

BRIEF DESCRIPTION OF THE DRAWINGS

The invention will be explained in greater detail with reference to illustrated embodiments. In the drawings.

DETAILED DESCRIPTION OF THE PREFERRED EMBODIMENTS

Figure 1:
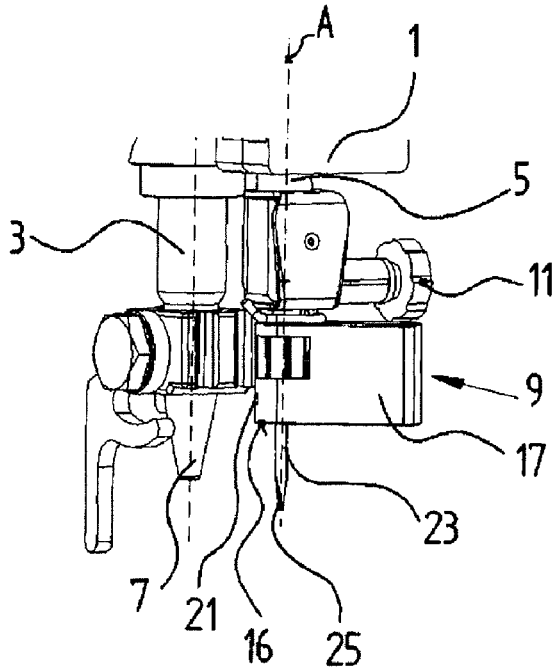
FIG. 1 is a perspective view of the mounting region for the presser foot and the sewing needle on a sewing machine.

In FIG. 1 a part of a sewing machine upper arm with the lower ends of the presser foot bar 3 and the needle bar 5 is designated with the reference symbol 1. For better clarity, the presser foot is not mounted on the cone 7 for holding the presser foot.

In the borehole (not visible) arranged coaxial to the needle bar axis A at the lower end of the needle bar 5, instead of a sewing needle, a turning device 9 is inserted or mounted with the help of the provided clamping device 11. The clamping device 11 is a standard part of the sewing machine with which the upper end of the sewing needle can be held and fixed.

In the enlarged diagram of the device 9, at the top a cylindrical pin 13 with a lateral flattened section 15 is visible. The pin 13 with the flattened section 15 corresponds to the upper end (shaft) of a commercially available sewing needle. Then on the pin 13, a cutting needle holder 16 arranged so that it can rotate on this pin is visible with a fin 17 that is supported or held in the axial direction by a supporting washer 19 or, in general, by a supporting device. A cutting needle 23 is mounted on the cutting needle holder 16 coaxial to the pin 13 underneath the supporting washer 19 by a fastening element, e.g., a screw 21 (not shown). The cutting needle 23 is provided on its upper end with the shaft of a sewing needle. On the lower end of the cutting needle 23, a cutting edge 25 is formed. This can have a straight-line or bent profile (compare cutting edge geometries according to WO98/24962).

The turning device 9 comprises a device for orienting the fin 17 or the cutting needle holder 16 into several defined angle positions on the pin 13. Advantageously, the supporting washer 19 is locked in rotation with the pin 13 or formed rigidly on the pin 13 and thus can be used at the same time as a basis for setting the angle positions for the cutting needle holder 16. Obviously, alignment elements that are independent of the supporting device could also be used alternatively for setting defined angle positions for the cutting needle holder 16. In the fin 17, in a borehole 27 extending at a right angle to the pin 13 and the axis A, a helical spring 29 is inserted that presses a catch pin 31 or a catch ball provided with a conical tip against the periphery of the supporting washer 19. In the supporting washer 19, dome-shaped or cone-shaped recesses 33 are formed as alignment elements in which the tip of the catch pin 31 can engage and can hold the fin 17 or the cutting needle 23 in the set angle position. The individual dome-shaped or cone-shaped recesses 33 lie, for example, at an angle of 45° relative to each other, so that the cutting edge 25 of the cutting needle 23 can pivot and be set in steps of 45°. Advantageously, e.g., four rotational positions oriented with respect to the ordinate of the orthogonal x-y coordinate system of the embroidery hoop at angles of 0°, 45°, 90°, and 135° are set rigidly by elastic catch elements and thus corresponding catch element receptacles. Obviously, fixed rotational positions in which the fin 17 can pivot and be fixed could also be given with other angle step widths, e.g., 30°.

Figure 2:
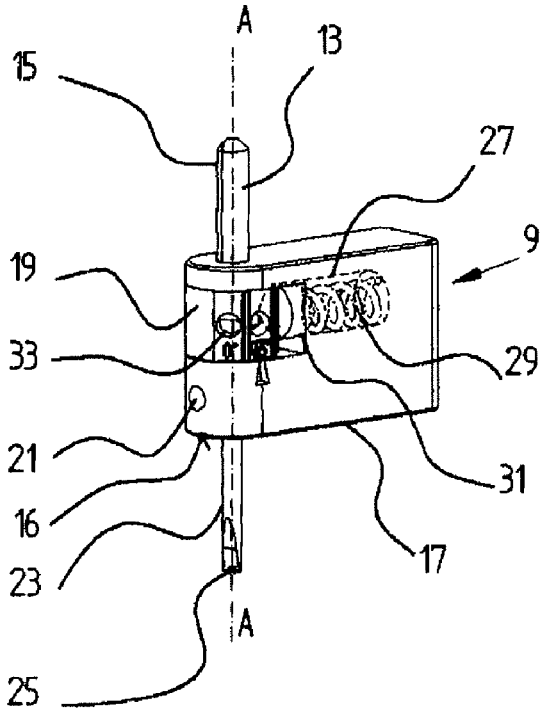
FIG. 2 is an enlarged view of a turning device for a cutting needle.
Figure 7:
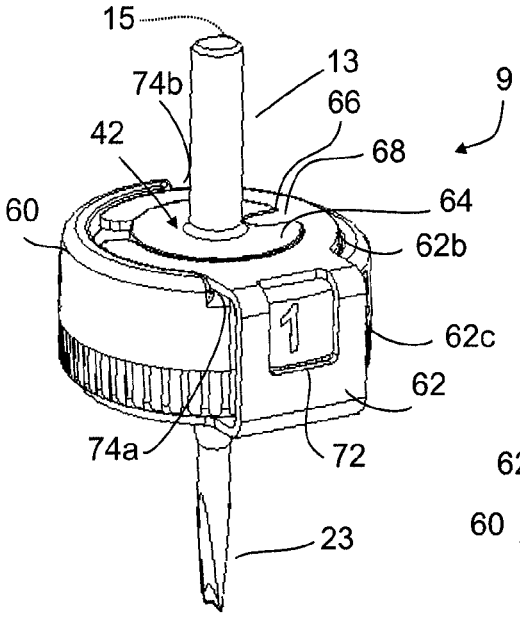
FIG. 7 is a perspective view of another preferred turning device with a cutting needle set therein.

The turning device 9 can be provided with a scale, with which the set rotational angle can be read (FIGS. 2, 7). Instead of a catch device with a catch pin 31 acting in the radial direction, a catch device could also be provided that engages, e.g., axially in the top side of the supporting washer 19 (not shown).

The rotational angle of the cutting edge 25 is set by a manual operation by the sewer in that he or she sets the cutting edge 25 of the cutting needle 23 according to changes in the contours to be cut. Alternatively, in the case of a programmable sewing machine, the command for changing the angle of the cutting needle 23 could be displayed to the sewer by the embroidery program.

Figure 3:
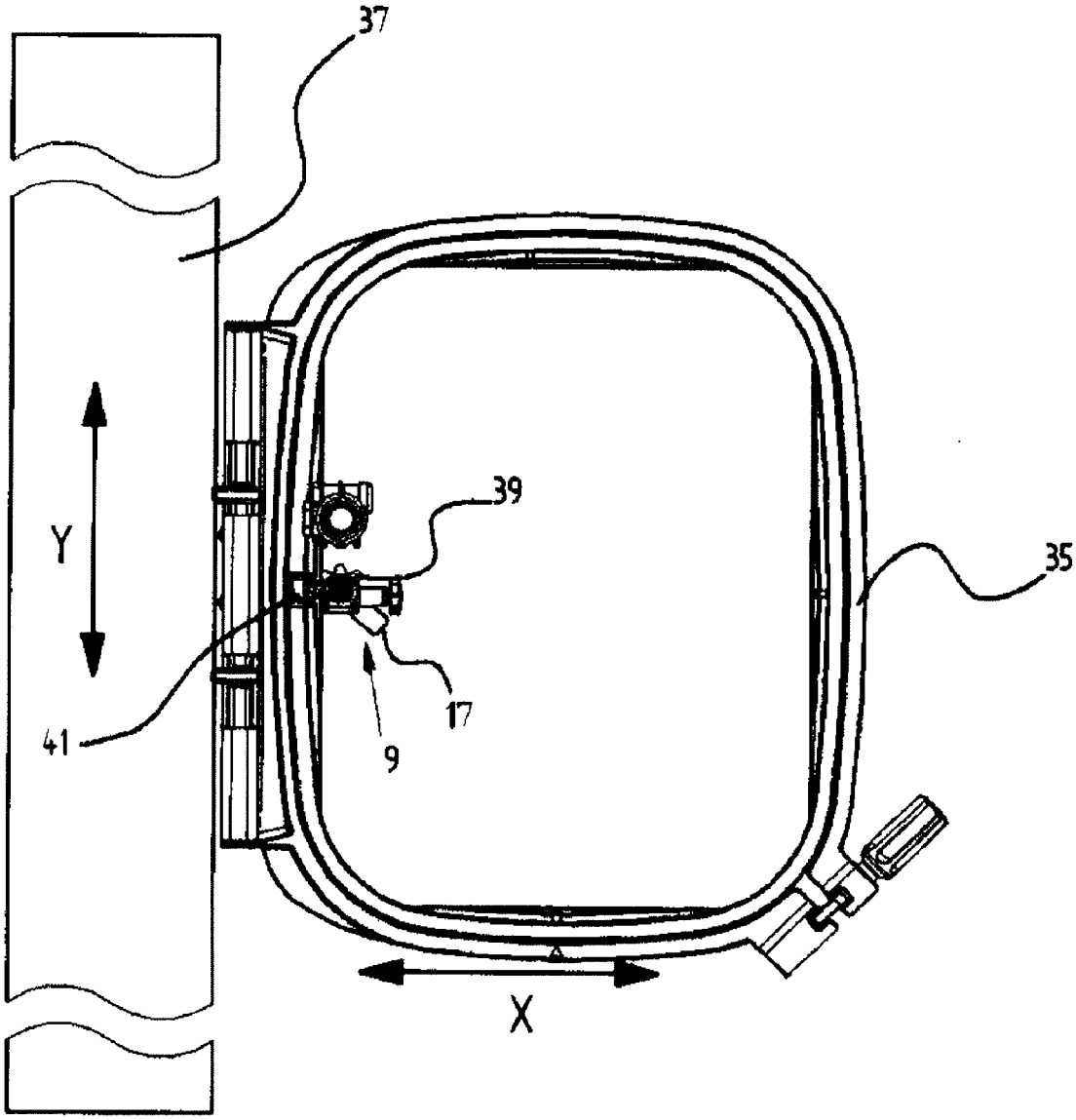
FIG. 3 is a horizontal section view through the turning device with a top view of an embroidery hoop with an activation element.

The fin 17 and thus also the cutting angle 25 of the cutting needle 23 could be turned into a plurality of given rotational positions by hand or alternatively by a drivable activation element—e.g., a fork or hook that is formed on the embroidery hoop and that can be moved together with this hoop and that can be moved by the zigzag drive of the sewing machine. In FIG. 3 that shows the top view of an embroidery hoop 35 and an embroidery module 37 driving the embroidery hoop 35 in the X and Y directions, the turning device 9 and the lower end of the presser foot bar 3 are also shown in section. A geared wheel segment 39 that can be brought into active connection with a coupling element 41 on the drive module 37 or on the embroidery hoop 35 is formed as a pusher dog on the cutting needle holder 16. The coupling element 41 that has, for example, a fork shape allows the pivoting of the turning device 9 to be performed without manual engagement. In this way, the pivoting movement of the cutting needle 23 can be performed with a provided driving means, here the embroidery hoop drive (embroidery module 37), in which the embroidery hoop 35 is brought with the coupling element 41 into meshing engagement with the geared wheel segment 39 in the case of a cutting needle 23 at its highest position and the rotational angle of the cutting needle 23 is reset by movement of the embroidery hoop 35.

In another construction of the invention, the pivoting motion, i.e., the setting of the cutting edge 25 of the cutting needle 23 is created with the help of the drive for the zigzag mode of the needle bar 5.

Figure 4:
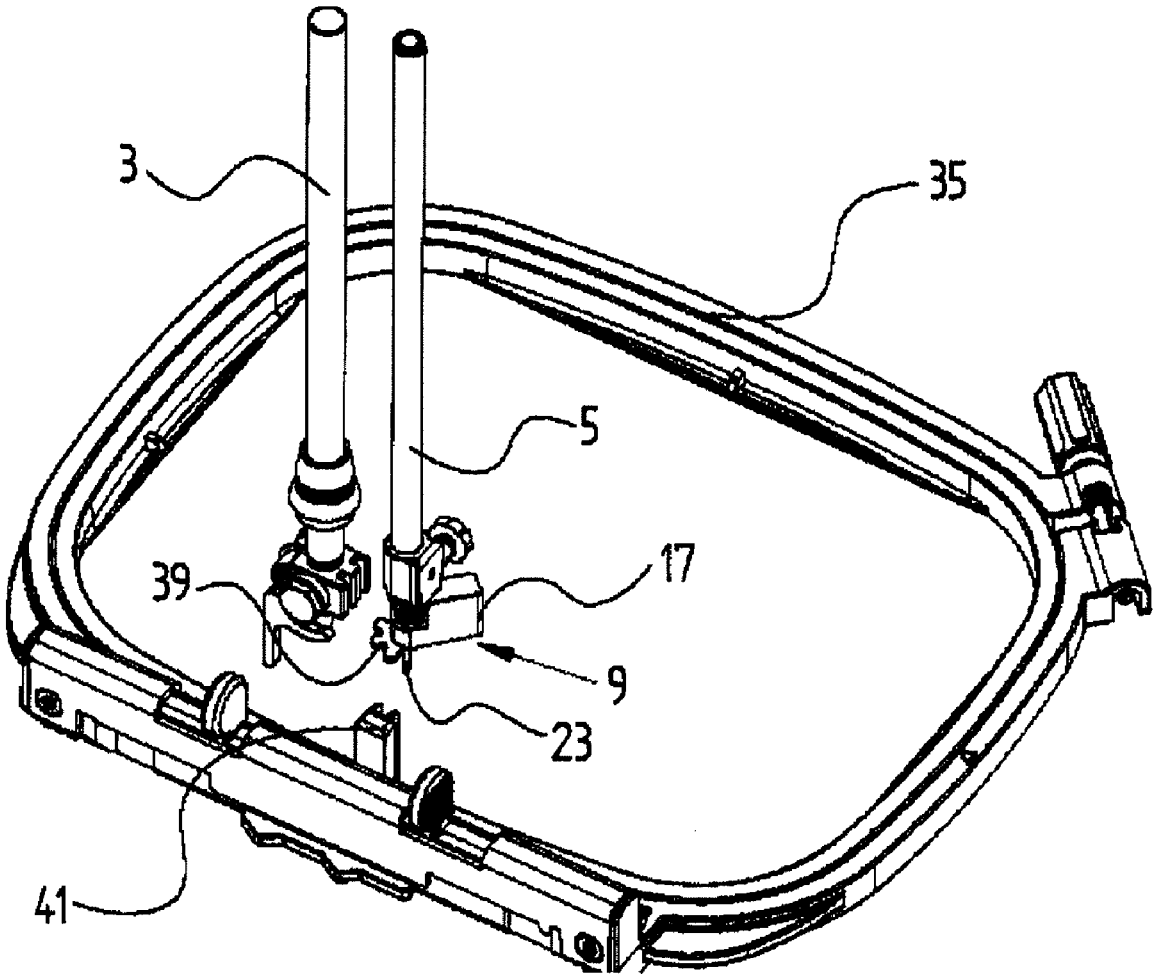
FIG. 4 is a perspective view of the turning device and the embroidery hoop and the presser foot bar with a geared segment as an activation element.
Figure 5:
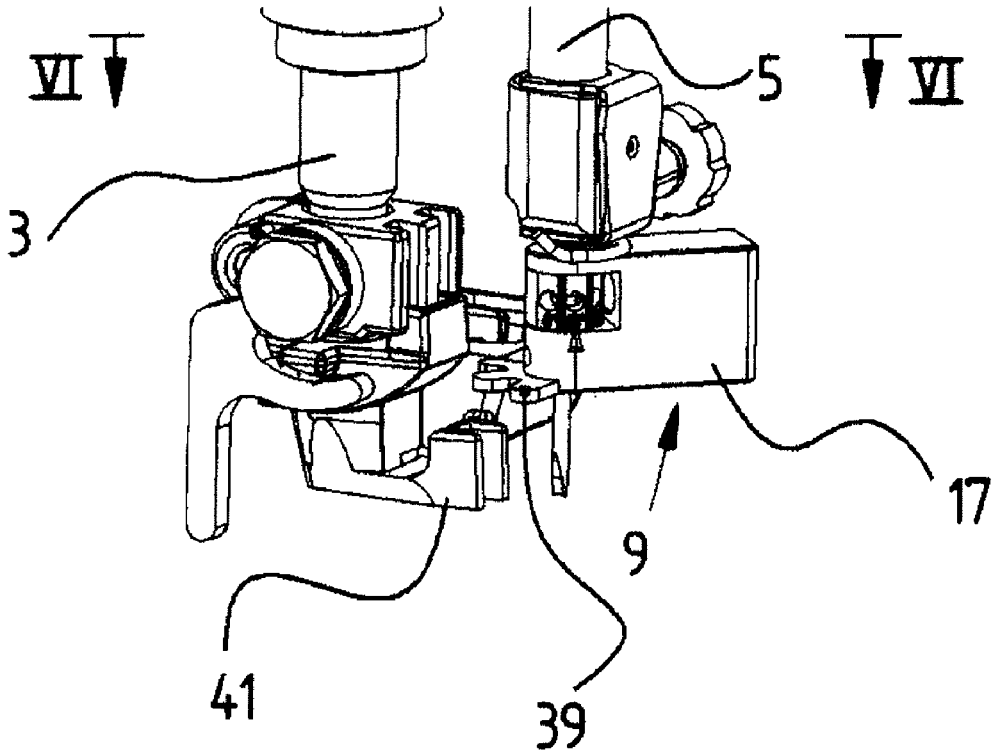
FIG. 5 is a perspective diagram of the turning device and the presser foot bar with an activation element.
Figure 6:
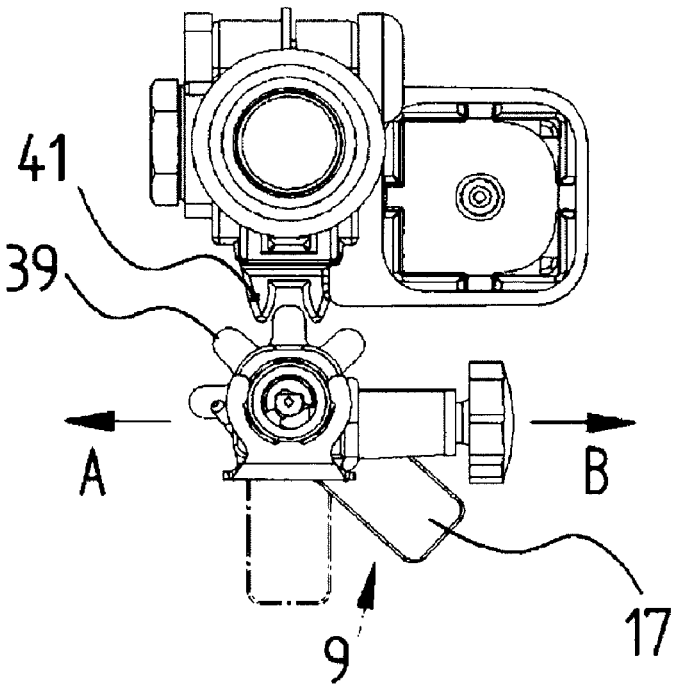
FIG. 6 is a horizontal section view taken along line VI-VI in FIG. 5.

In FIGS. 5 and 6, fork-shaped or tooth-shaped coupling elements 41 are arranged on the presser foot bar 3. As in the second embodiment according to FIGS. 3 and 4, these are used for adjusting the rotational angle of the turning device 9 engaged with the geared wheel segment. In order to create this engagement and thus the turning of the cutting needle 23, the needle bar 5 is lowered or raised until the geared wheel segment 39 lies within the coupling element 41. Now, with the drive for the zigzag mode, the needle bar 5 can be pivoted with the turning device mounted thereon either in the direction of the arrow A, i.e., toward the left in FIG. 6, or in the direction of arrow B, i.e., toward the right in FIG. 6. Through the pivoting movement, the geared segment 39 and, with it, the turning device 9 are pivoted either in the clockwise direction or in the counterclockwise direction. The pivoting movement does not have to correspond exactly to the desired catch rotational angle, but instead only approximately, because the definitive and exact rotational angle setting is reached by the catch pin 31. Obviously there must be sufficient play between the fork-shaped coupling element 41 and the teeth on the geared wheel segment 39, so that these two elements do not touch during the cutting process when the geared segment always travels vertically through the coupling element 41. If the cutting needle 23 should be turned by more than one catch angle, then the process must be repeated. For this rotational angle setting of the turning device 9 controlled by the embroidery program of the sewing machine, only the fork-shaped coupling element 41 must be brought onto the presser foot bar 3. If the turning device 9 is set by hand, then there are no problems, because the geared wheel segments 49 always travel through the coupling element 41 without contact during the cutting.

FIGS. 7 to 11 show another preferred embodiment of a turning device 9, wherein a support housing 42 that is open towards the bottom is formed on the bottom side of the pin 13. In this support housing 42, the cutting needle holder 16 is supported so that it can rotate. The cutting needle holder 16 is advantageously a processed, turned part made from metal or plastic or alternatively an injection-molded part and comprises a first shaft stub 44 projecting upward, a second shaft stub 46 projecting downward coaxial thereto or to the rotational axis A and in-between a collar 48 projecting in the radial direction. The first shaft stub 44 is inserted from below into the opening on the support housing 42 and is supported so that it can rotate with minimal play relative to the inner wall of the support housing 42. A retaining ring 50 engaging in a peripheral groove on the lateral surface of the first shaft stub 45 and on the inner wall of the support housing 42 secures the cutting needle holder 16 in its axial position on the support housing 42. The outer diameter of the second shaft stub 46 is greater than that of the first shaft stub 44. The outer diameter of the collar 48 is greater than that of the second shaft stub 46. A segment-like section of the turning part exposes a flat stop face 52 in the region of the collar 48 and the second shaft stub 46. An advantageously continuous axial borehole 54 of the cutting needle holder 16 is used for the introduction of the shaft of the cutting needle 23. A radial borehole 56 arranged in the region of the stop face 52 is provided with internal threading and is used for the clamping and the rotationally locked fixing of the cutting needle 23 on the cutting needle holder 16, for example, with a headless screw 58. A setting ring 60 surrounding the support housing 42 and the cutting needle holder 16 is held so that it can rotate on the support housing 42 by an elastic holder 62 shaped like a U viewed from the side. The holder 62 comprises a lower leg 62*a*, an upper leg 62*b*, and a base leg 62*c* connecting these two sections. The setting ring 60 is constructed like a cup with a recess 70 on the side of the base, wherein this recess 70 is adapted to the contours of the second shaft stub 46, such that the shaft stub 46 engages in the recess 70 after the setting ring 60 is pushed onto the cutting needle holder 16 and guarantees a rotationally locked coupling of the setting ring 60 with the cutting needle holder 16. The holder 62 surrounds the setting ring 60 like a bracket and holds this on the support housing 42 in its axial position.

The lower leg 62*a* of the holder 62 comprises a circular ring-shaped section whose inner diameter is slightly greater than the outer diameter of the second shaft stub 46 of the cutting needle holder 16. The opening of the lower leg 62*a* is pushed over the lower end of the second shaft stub 46. Therefore, due to the minimal play, the holder 62 and the second shaft stub 46 are oriented relative to each other in the radial direction and can rotate relative to each other. The upper leg 62*b* of the holder 62 comprises an approximately circular ring-shaped bracket-like section that is held locked in rotation on a corresponding step 64 projecting in the axial direction on the top side of the support housing 42. For this purpose, a radial indentation 66 could be formed, e.g., on the step 64 and a finger 68 engaging in this indentation could be formed on the upper leg 62*b* of the holder 62. The two legs 62*a*, 62*b* of the holder 62 are slightly pretensioned against each other, such that the lower leg 62*a* allows the setting ring 60 set on top of it to press with a small upward force against the support housing 42.

Figure 8:
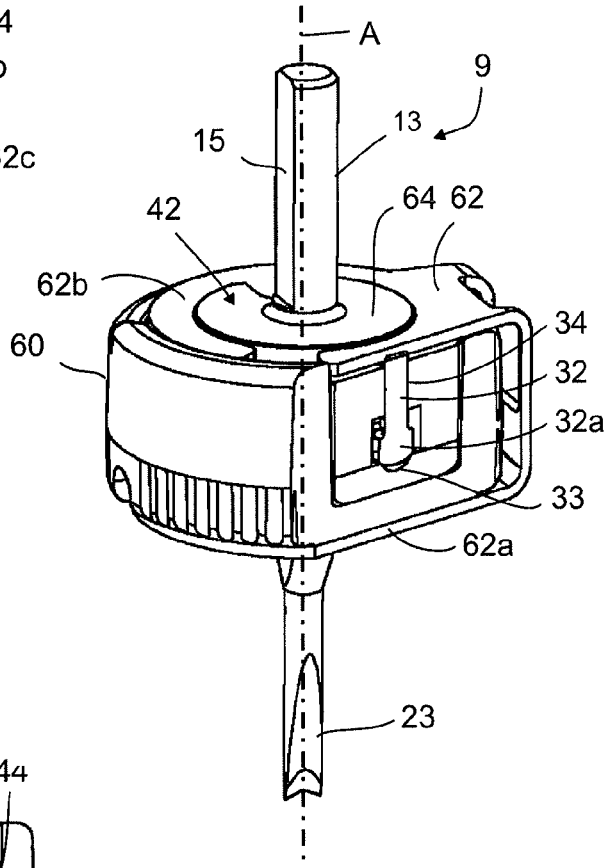
FIG. 8 is a section view of the turning device from FIG. 7 taken along a first vertical section plane.
Figure 9:
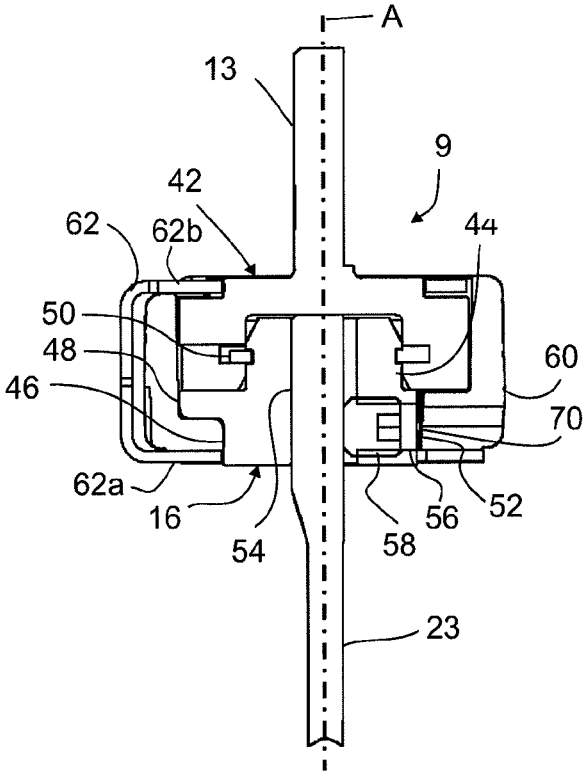
FIG. 9 is a longitudinal section view of the turning device from FIG. 7.
Figure 10:
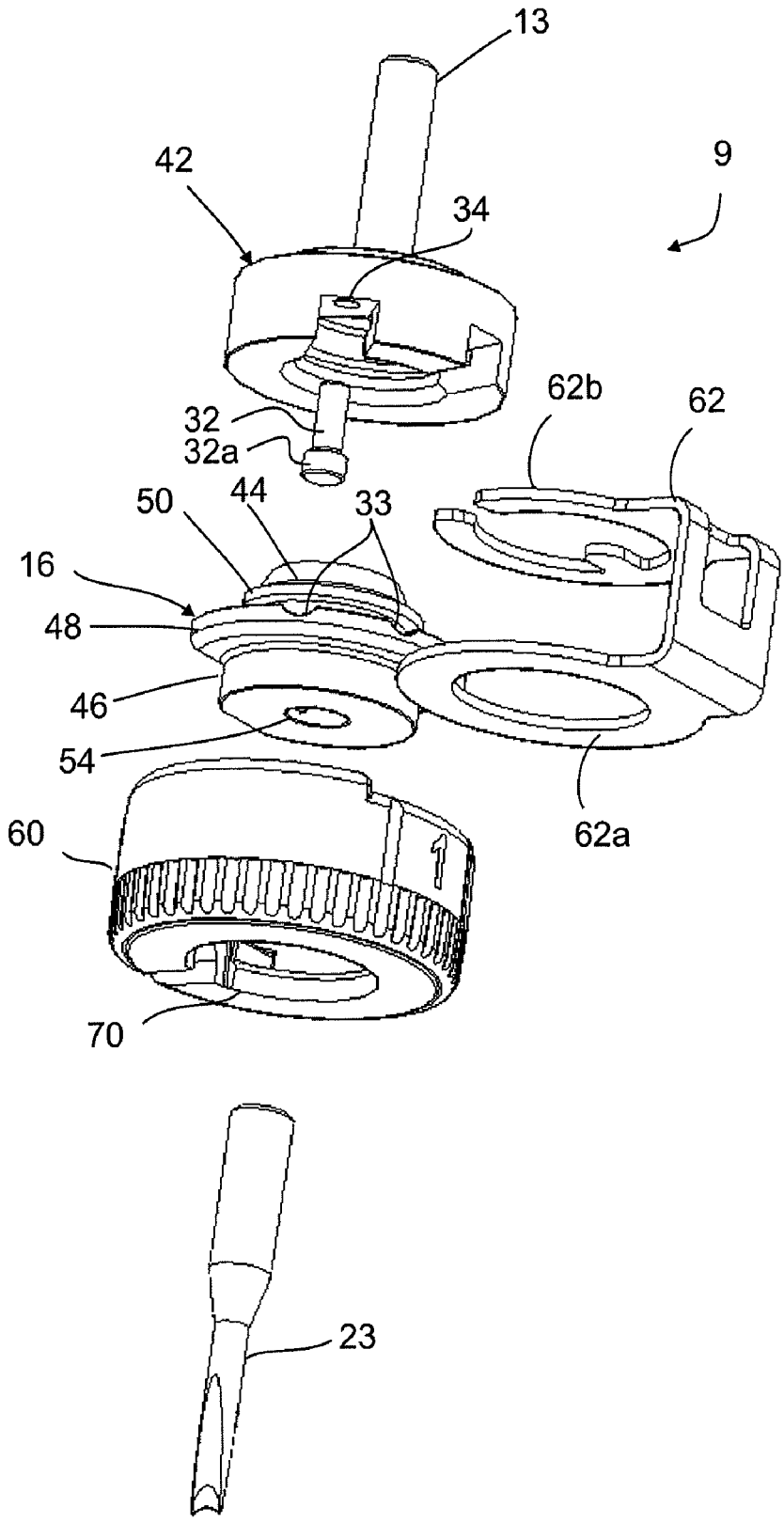
FIG. 10 is a first exploded view of the turning device from FIG. 7.
Figure 11:
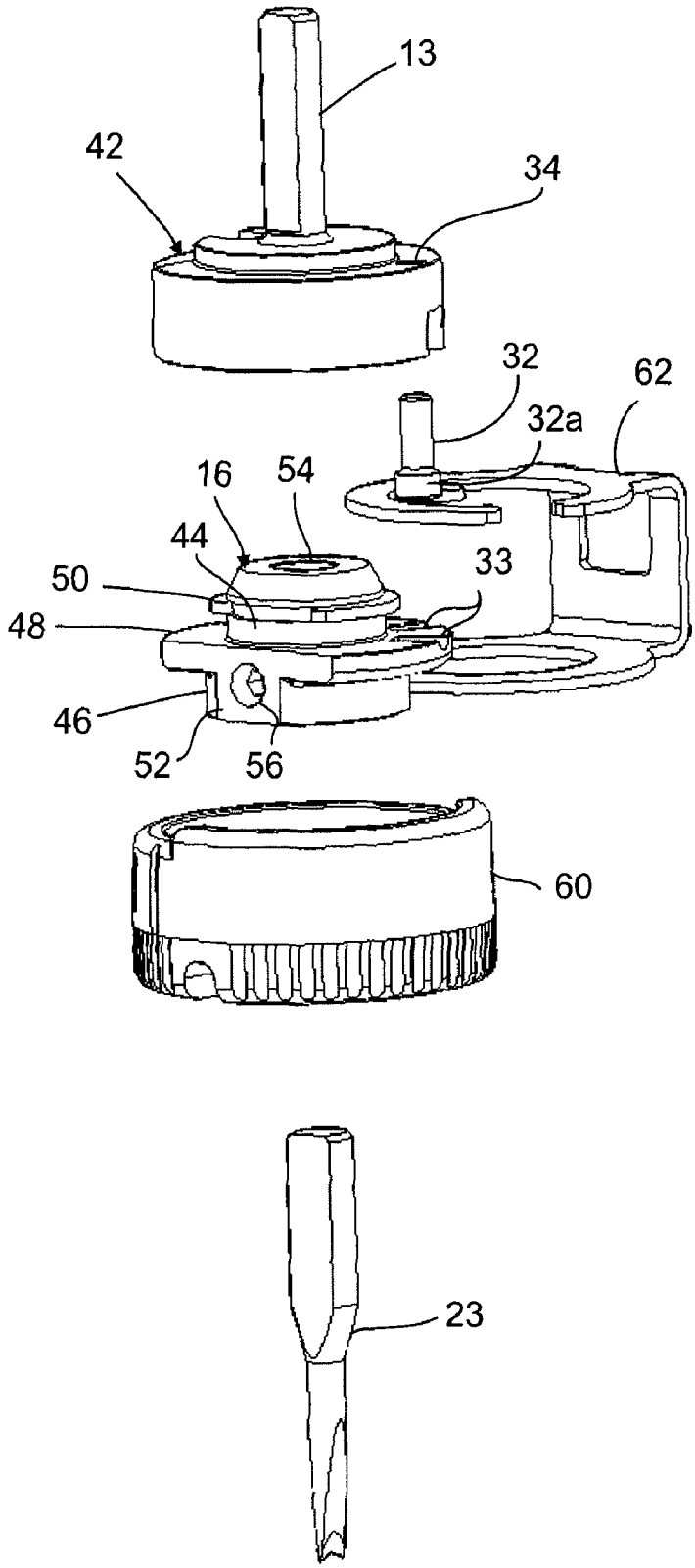
FIG. 11 is a second exploded view of the turning device from FIG. 7.

On the top side of the collar 48 projecting on the cutting needle holder 16 there are, at given angle distances, cylinder segment-shaped recesses 33 that have the function of catch element receptacles or that are used as alignment elements for specifying defined rotational angle positions for the cutting needle holder 16. A bolt 32 is provided as the catch element—analogous to the catch pin 31 in the embodiment according to FIG. 2. This bolt 32 is supported so that it can move guided in a continuous borehole 34 on the top side of the support housing 42. The size and shape of a bolt head 32*a* formed on the bolt 32 at the bottom is matched to the recesses 33 in the collar 48 such that the bolt head 32*a* is inserted at least partially into these recesses 33 and therefore the cutting needle holder 16 allows locking in the corresponding angle positions. The length of the bolt 32 is dimensioned so that its rear end projects only slightly past the upper edge of the borehole 34 and advantageously contacts the bottom side of the upper leg 62*b* of the holder 62 when the bolt head 32*a* is inserted into one of the recesses 33, as shown in FIG. 8. When the setting ring 60 is turned, the bolt 32 is raised slightly and presses at least one part of the upper holder leg 62*b* slightly upward against its restoring spring force. As soon as the setting ring 60—and thus also the cutting needle holder 16 and the cutting needle 23—is turned in the region of the closest, given rotational angle position, the bolt head 32*a* is pressed by the restoring spring force of the holder 62 into the associated recess 33 and therefore locks the cutting needle holder 16 exactly at the given angle position. Instead of the bolt 32 in connection with the elastic holder 62, a catch ball 31 in connection with a compression or helical spring 29 could also be provided—analogous to the construction according to FIG. 2. A code or indexing mark (e.g., a numeral) that is printed on the lateral surface of the setting ring 60 and that specifies the corresponding angle position is visible through a recess 72 on the base leg 62*c* at the given angle positions.

Stop faces 74*a*, 74*b* (FIG. 7) can be formed on the setting ring 60, wherein these stop faces limit the pivoting region of the cutting needle holder 16, in that they contact, e.g., the holder 62 when the setting ring 60 is turned.

The embodiment of the turning device 9 shown in FIGS. 7 to 11 is formed, for the manual adjustment of the positional angle of the cutting needle 23 by turning the setting ring 60. For someone skilled in the art, it is easily seen that a geared wheel segment 39 or another coupling part for the automatic setting of the angle position of the cutting needle holder 16 could be formed on the setting ring 60 analogous to the embodiment according to FIG. 4.

For the embodiment according to FIGS. 7 to 11, the elastically supported catch element is active in the axial direction and is locked in rotation relative to the pin 13. Accordingly, the catch element receptacles or recesses 33 can pivot about the rotational axis A.

For better understanding of the function of the cutting device, in FIGS. 12, 13, 14, and 15 the sheet material 51 to be processed is shown in different processing states, wherein elements are also partially shown that, in reality, are not visible.

Figure 12:
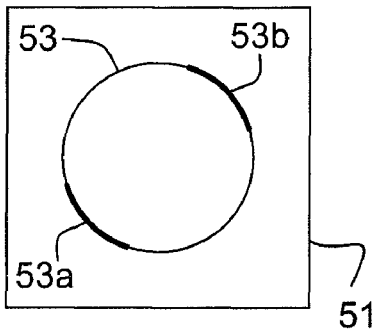
FIG. 12 is a view of a sheet material with cutting line shown symbolically.

FIG. 12 shows a circular cutting line 53 (that is really not visible) along which the sheet material 51 is to be cut. The cutting line 53 is divided, according to the four possible, given cutting edge orientations in the present example, into sequences each with sections that are each to be cut with one of the cutting edge orientations. One of these sequences with the two sections 53*a* and 53*b* is emphasized with bold lines in FIG. 12. The individual sections 53*a*, 53*b* are longer than one eighth of the periphery of the cutting line 53, so that adjacent sections overlap (not shown). The individual sequences are stored in a memory of the sewing machine controller analogous to different sewing yarn colors of an embroidery pattern in the overall embroidery pattern file.

The overall embroidery pattern file could be stored, e.g., completely in a memory accessible to the sewing machine controller and could be loaded before the execution of the cutting process. Alternatively, however, stored conventional embroidery pattern data could also be loaded into the sewing machine controller, wherein this controller executes the necessary processing steps for generating the overall embroidery pattern file before the execution of the cutting process. This has the advantage that any embroidery patterns can be read into the sewing machine and that cutting processes can be performed with a different number of given cutting edge orientations. (For the calculation of the overall embroidery pattern file, the number and direction of the cutting edge orientations that are set or that can be set can be taken into account).

Figure 13:
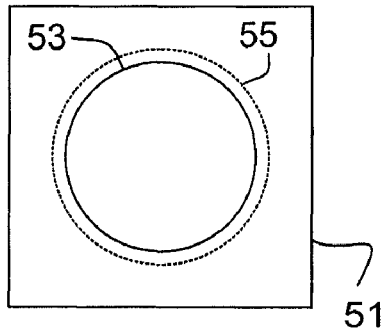
FIG. 13 is a view of the sheet material from FIG. 12 after the sewing of stay stitching.

FIG. 13 shows, outside of the circular area to be cut, stay stitching 55 that runs at a small distance (e.g., approximately 0.5 mm to approximately 3 mm) to the cutting line 53 and that is sewn before the cutting process. After the four sequences of the cutting line 53 as shown in FIG. 3 have been cut with four different needle settings (by moving the embroidery hoop with the tensioned sheet material 51 and simultaneously oscillating the needle bar 5 with the cutting needle 23) and after the cut circular area has been removed, the cut edge 57 is now visible. Due to the limited number of different cutting edge orientations, it could have a slight grid-like or jagged structure. With the suitable selection of parameters, such as the cutting length of the cutting needle 23, the distance or relative position of adjacent stitch points, and/or the overlapping lengths when cutting with different cutting edge orientations, however, this grid-like structure is barely recognizable.

Figure 14:
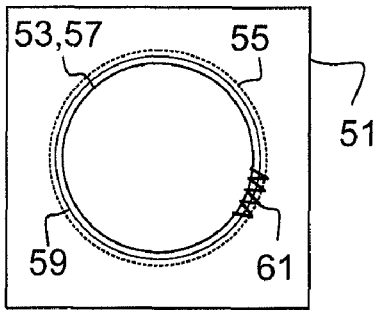
FIG. 14 is a view of the sheet material from FIG. 13 showing the case of neatening by a satin stitch after cutting along the cutting line.
Figure 15:
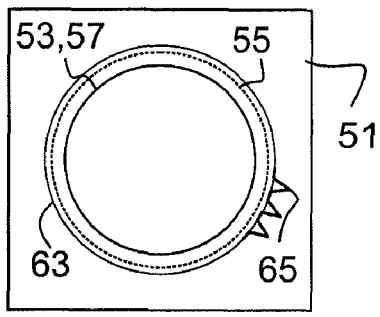
FIG. 15 is a view of the sheet material from FIG. 13 in the case of embellishment by a peripheral decorative stitch after cutting along the cutting line.

FIG. 14 shows symbolically (actually not visible) parallel contours 59 between the cutting line 53 and the stay stitching 55. Along these parallel contours 59, if needed, satin stitches 61 are formed for creating a neater appearance for the cut edge 57, wherein these satin stitches 61 cover the cut edge 57 and the stay stitching 55. Instead of or in addition to satin stitches 61, as shown in FIG. 15, along additional parallel contours 63 calculated at a small distance outside of the stay stitching 55, decorative stitches 65 are sewn for embellishing the cut edge 57. Such optional satin or decorative stitches can be already set, e.g., in the overall embroidery pattern file or can be alternatively defined by a dialog with the user after completion of the cutting sequences.

LIST OF REFERENCE SYMBOLS

1 Sewing-machine upper arm
3 Presser foot bar
5 Needle bar
7 Cone
9 Turning device
11 Clamping device
13 Pin
15 Flattened section
16 Cutting needle holder
17 Fin
19 Supporting washer
21 Screw
23 Cutting needle
25 Cutting edge
27 Borehole
29 Helical spring
31 Latch pin
32 Bolt
32*a* Bolt head
33 Recess
34 Borehole
35 Embroidery hoop
37 Drive module
39 Geared wheel segment
41 Coupling element
42 Support housing
44 First shaft stub
46 Second shaft stub
48 Collar
50 Retaining ring
51 Sheet material
52 Stop face
53 Cutting line
54 Axial borehole
53*a*, 53*b* Sections
56 Radial borehole
55 Stay stitching
57 Cut edge
58 Headless screw
59 Parallel contours
60 Setting ring
61 Satin stitches
62 Holder
62*a* First leg
62*b* Second leg
62*c* Base leg
63 Additional parallel contours
64 Step
65 Decorative stitches
66 Indentation
68 Finger
70 Base-side recess
72 Recess
74*a*, 74*b* Stop faces

The invention claimed is:

1. Device for cutting textile and non-textile sheet materials with a sewing machine, comprising: a turning device (9) with a pin (13) that can be mounted locked in rotation on a needle bar (5) of the sewing machine and can be set by the needle bar into an oscillating vertical motion, a cutting needle holder (16) supported on the pin (13) so that it can rotate about a rotational axis A, a cutting needle (23) located in a borehole (54) in the cutting needle holder, the rotational axis A of the cutting needle holder is coaxial to the borehole (54) in the cutting needle holder, and the cutting needle holder (16) can be moved to and is lockable at predetermined rotational angle positions.

2. Device according to claim 1, wherein alignment elements are formed on the pin (13) or are connected locked in rotation with the pin (13) for specifying the predetermined rotational angle positions.

3. Device according to claim 2, wherein a supporting washer (19) is formed on the pin (13) or connected locked in rotation with the pin (13) for specifying an axial position of the cutting needle holder (16) and the alignment elements are formed on the supporting washer (19).

4. Device according to claim 1, wherein the cutting needle holder (16) comprises a mount (21) for mounting the cutting needle (23).

5. Device according to claim 1, wherein the cutting needle holder (16) comprises a locking device (31) for fixing a rotational position with respect to the needle bar (5).

6. Device according to claim 1, wherein the cutting needle holder (16) comprises at least one of a fin (17) projecting in a radial direction from the rotational axis A or a geared wheel segment (39) with which the rotational position of a cutting edge (27) on the cutting needle (23) can be set.

7. Device according to claim 6, wherein the geared wheel segment (39) on the cutting needle holder (16) can be turned by hand or with a coupling element (41) on a handling element.

8. Device according to claim 7, wherein the coupling element (41) is arranged on an embroidery hoop (35) or on a drive module (37) of the embroidery hoop (35) and can be brought temporarily into engagement with the geared segment (39) for setting the rotational angle.

9. Device according to claim 7, wherein the coupling element (41) is arranged on a presser foot bar (3) of the sewing machine and comprises a fork-shaped coupling part that is constructed such that the geared wheel segment (39) can pass without contact and with play between cheeks of the coupling element (41) during the cutting stroke, and for setting the cutting angle of the cutting needle (23), the geared wheel segment (39) can be guided between the cheeks of the coupling element (41), and for setting the rotational angle, a drive for a zigzag movement of the needle bar (5) can be activated and rotation of the cutting needle (23) is provided by a lateral deflection of the needle bar (5).

10. Device according to claim 1, wherein an indexer is formed on the turning device (9) for fixing the setting and locking of the angle at different angle positions.

11. Device according to claim 1, wherein a support housing (42) for the rotatable support of the cutting needle holder (16) is formed on the pin (13) or is connected locked in rotation with the pin (13), recesses (33) or other catch element receptacles are formed on the cutting needle holder (16), and catch elements are spring mounted on the support housing (42), with the catch elements being formed together with the catch element receptacles for locking the cutting needle holder (16) at specified rotational angle positions.

12. Method for cutting a textile or non-textile sheet material (51) along a specified cutting line (53), comprising:

providing a device for cutting textile and non-textile sheet materials with a sewing machine having a turning device (9) with a pin (13) that can be mounted locked in rotation on a needle bar (5) of the sewing machine and can be set by the needle bar into an oscillating vertical motion, a cutting needle holder (16) supported on the pin (13) so that it can rotate about a rotational axis A, a cutting needle (23) with a cutting edge (25) connected locked in rotation with the cutting needle holder (16), and the cutting needle holder (16) can be moved to and is lockable at predetermined rotational angle positions, holding a piece of sheet material (51) in a hoop and moving it in a controlled manner by a controller in a plane underneath the needle bar (5) of the sewing machine, calculating sections (53*a*, 53*b*) of the cutting line (53) for each of the predetermined rotational angle positions of the cutting needle holder (16), so that the sections are to be cut with the corresponding cutting edge alignment, successively moving the cutting needle holder (16) into each of the rotational angle positions necessary for cutting the cutting line (53), and for each respective one of the rotational angle positions, cutting all of the sections (53*a*, 53*b*) of the cutting line (53) to be cut with the corresponding cutting edge alignment.

* * * * *